US008453305B2

(12) United States Patent
Wern

(10) Patent No.: US 8,453,305 B2
(45) Date of Patent: Jun. 4, 2013

(54) PEEN FINISHING

(75) Inventor: Michael J. Wern, Mokena, IL (US)

(73) Assignee: Engineered Abrasives, Inc., Alsip, IL (US)

( * ) Notice: Subject to any disclaimer, the term of this patent is extended or adjusted under 35 U.S.C. 154(b) by 301 days.

(21) Appl. No.: 12/836,087

(22) Filed: Jul. 14, 2010

(65) Prior Publication Data

US 2011/0017006 A1 Jan. 27, 2011

Related U.S. Application Data

(60) Provisional application No. 61/225,304, filed on Jul. 14, 2009.

(51) Int. Cl.
*B21C 37/30* (2006.01)

(52) U.S. Cl.
USPC ..... 29/90.7; 29/893.3; 451/36

(58) Field of Classification Search
USPC ..... 29/90.7, 893.3, 893.37, 893.35; 451/32, 451/36
See application file for complete search history.

(56) References Cited

U.S. PATENT DOCUMENTS

| | | | | |
|---|---|---|---|---|
| 2,352,857 | A | | 7/1944 | Nachemov |
| 2,420,759 | A | | 5/1947 | Stelz |
| 2,725,685 | A | | 12/1955 | Hill |
| 3,073,022 | A | | 1/1963 | Bush et al. |
| 3,419,894 | A | | 12/1968 | Burney et al. |
| 3,423,976 | A | | 1/1969 | Burney et al. |
| 3,613,424 | A | | 10/1971 | Normos |
| 4,167,864 | A | | 9/1979 | Taipale |
| 4,480,411 | A | * | 11/1984 | Balz et al. ..... 451/326 |
| 5,107,630 | A | | 4/1992 | Lodewijk |
| 5,216,848 | A | | 6/1993 | Abbott et al. |
| 5,251,468 | A | | 10/1993 | Lin et al. |
| 5,272,897 | A | | 12/1993 | Wern |
| 5,302,324 | A | | 4/1994 | Morikawa et al. |

(Continued)

FOREIGN PATENT DOCUMENTS

| | | |
|---|---|---|
| EP | 0995530 | 4/2000 |
| JP | 54-153315 | 12/1979 |

(Continued)

OTHER PUBLICATIONS

Society of Automotive Engineers, SAE Manual on Shot Peening, Apr. 2001, Fourth Edition, p. 6.

(Continued)

*Primary Examiner* — David Bryant
*Assistant Examiner* — Ryan J Walters
(74) *Attorney, Agent, or Firm* — Barnes & Thornburg LLP

(57) ABSTRACT

The present invention is directed to a method and apparatus for processing a metallic gear comprising providing a gear, directing a first peening media at the metallic gear thereby exposing a plurality of surfaces on the metallic gear to the first peening media whereby the strength and wear properties of the teeth roots of the gear are enhanced, directing a second peening media at the metallic gear thereby exposing a plurality of surfaces on the metallic gear to the second peening media whereby the KSI of the surface of the gear is enhanced, providing a container, placing a fine finishing medium in the container, placing the gear with the fine finishing medium in the container, coupling vibrations to the container to vibrate the fine finishing medium with the wetted gear, removing the gear from the container, washing the gear and rinsing the gear with rust inhibitor.

15 Claims, 8 Drawing Sheets

U.S. PATENT DOCUMENTS

| | | | | |
|---|---|---|---|---|
| 5,503,591 | A | 4/1996 | Morikawa et al. | |
| 5,599,223 | A | 2/1997 | Mains, Jr. | |
| 5,704,239 | A | 1/1998 | Beals et al. | |
| 5,709,587 | A | 1/1998 | Shaffer | |
| 5,873,770 | A * | 2/1999 | Hashimoto | 451/32 |
| 5,879,223 | A | 3/1999 | Frederick et al. | |
| 5,911,780 | A | 6/1999 | Hamasaka et al. | |
| 6,038,900 | A | 3/2000 | Miyasaka | |
| 6,238,268 | B1 | 5/2001 | Wern | |
| 6,315,646 | B1 | 11/2001 | Hoyashita | |
| 6,612,909 | B2 | 9/2003 | Wern | |
| 2002/0072306 | A1 | 6/2002 | Carpenter | |
| 2003/0186626 | A1 | 10/2003 | Carpenter | |
| 2008/0104842 | A1 * | 5/2008 | Michaud et al. | 29/893.3 |

FOREIGN PATENT DOCUMENTS

| | | |
|---|---|---|
| JP | 56-76306 | 6/1981 |
| JP | 58-091118 | 5/1983 |
| JP | 62-253723 | 11/1987 |
| JP | 63-96816 | 4/1988 |
| JP | 1-271175 | 10/1989 |
| JP | 07-060647 | 3/1995 |
| JP | 8-73930 | 3/1996 |
| JP | 08-229820 | 9/1996 |
| JP | 09-85624 | 8/1999 |
| JP | 2000-280120 | 10/2000 |
| JP | 2000-297273 | 10/2000 |
| JP | 2004/345022 | 12/2004 |
| WO | WO 01/96069 | 12/2001 |

OTHER PUBLICATIONS

Society of Automotive Engineers, SAE Manual on Shot Peening, No Date or Edition found, p. 15.

Search Report issued in application No. EP 10169858 (2012).

* cited by examiner

PEEN FINISHING

CROSS REFERENCE TO RELATED APPLICATION

This application claims benefit of U.S. Provisional Application No. 61/225,304 filed 14 Jul. 2009, the contents of which are incorporated herein by reference.

BACKGROUND OF THE INVENTION

This invention relates generally to a method for media blasting and peen finishing a gear or other workpiece or part. The powered part hold-down apparatus of U.S. Pat. No. 5,272,897 may be used for the peening step(s) of the present disclosure and the disclosure of the U.S. Pat. No. 5,272,897 patent is hereby incorporated in its entirety by this reference.

Media blasting or peening is used to increase the fatigue strength of a gear, workpiece or part. Gears, such as those utilized in automobile transmissions are media blasted to increase their surface durability and ensure that they are suitable for performing their intended functions. The media blasting steps of the present invention includes the steps disclosed in U.S. Pat. No. 6,612,909 and the disclosure of the U.S. Pat. No. 6,612,909 patent is hereby incorporated in its entirety by reference.

A workpiece such as a gear is placed in a closed chamber, the blasting system is actuated whereby media are mixed with air and after mixing of the media and air a stream of the air/media mixture is directed against the workpiece. This process is referred to as peening.

OBJECTS AND SUMMARY OF THE INVENTION

An object of the present invention is to strengthen the root radius and tooth face of gears by peening the gears and then vibratory finishing. Peening steps toughen the gears and provide roughness to the gear surfaces. Finishing after peening smoothes the gear surfaces and leaves dimples or indentations. The dimples or indentations help to maintain oil retention on gear surfaces. The vibratory process after peening is to bring surface Ra down to a lower Ra (5-25 microns) that is economical for medium and higher volume parts. Super finishing or similar processes to bring the Ra surface down to 1 Ra or lower is cost prohibited. "Ra" is an international roughness standard. See for example, ISO (International Organization for Standardization) standard 4287.

An object of the present invention is to provide a method of processing a metallic workpiece comprising media blasting of the workpiece (e.g., a gear) by directing a first media (e.g., cut wire) against exposed surfaces on the workpiece to increase the root strength of the gear, ceasing the first blasting and media blasting the workpiece with a second media (e.g., glass, ceramic or FINE STEEL™ beads) against exposed surfaces on the workpiece to provide a high surface compressive stress (KSI) on the tooth face and the root, providing a container (e.g., bowl), placing a fine finishing medium (wet or dry) in the container with the workpiece, coupling vibrations to the container to vibrate the fine finishing medium with the workpiece, removing the workpiece from the container, washing the workpiece, and rinsing the workpiece with rust inhibitor whereby wear properties of the workpiece are enhanced. Media blasting of gears according to the present invention accomplishes an important object which is to strengthen the root radius and surface of the gears. In the present disclosure toughness is discussed in terms of "KSI" (kilo-pound[-force] per square inch) or 1000 psi. KSI is often used in materials science, civil and mechanical engineering to specify stress and Young's modulus.

Another object of the present invention is to provide a workpiece (e.g., a gear, shaft or other metal parts) which has been media blasted and subsequently processed (fine finished) to provide a workpiece finish Ra of about 5-25 microns and also have a much higher KSI on the surface than other processes using vibratory or super finishing type steps.

BRIEF DESCRIPTION OF THE DRAWINGS

The present invention will now be described, by way of example, with reference to the accompanying drawings in which.

DETAILED DESCRIPTION OF PREFERRED EMBODIMENTS

Figure 1:
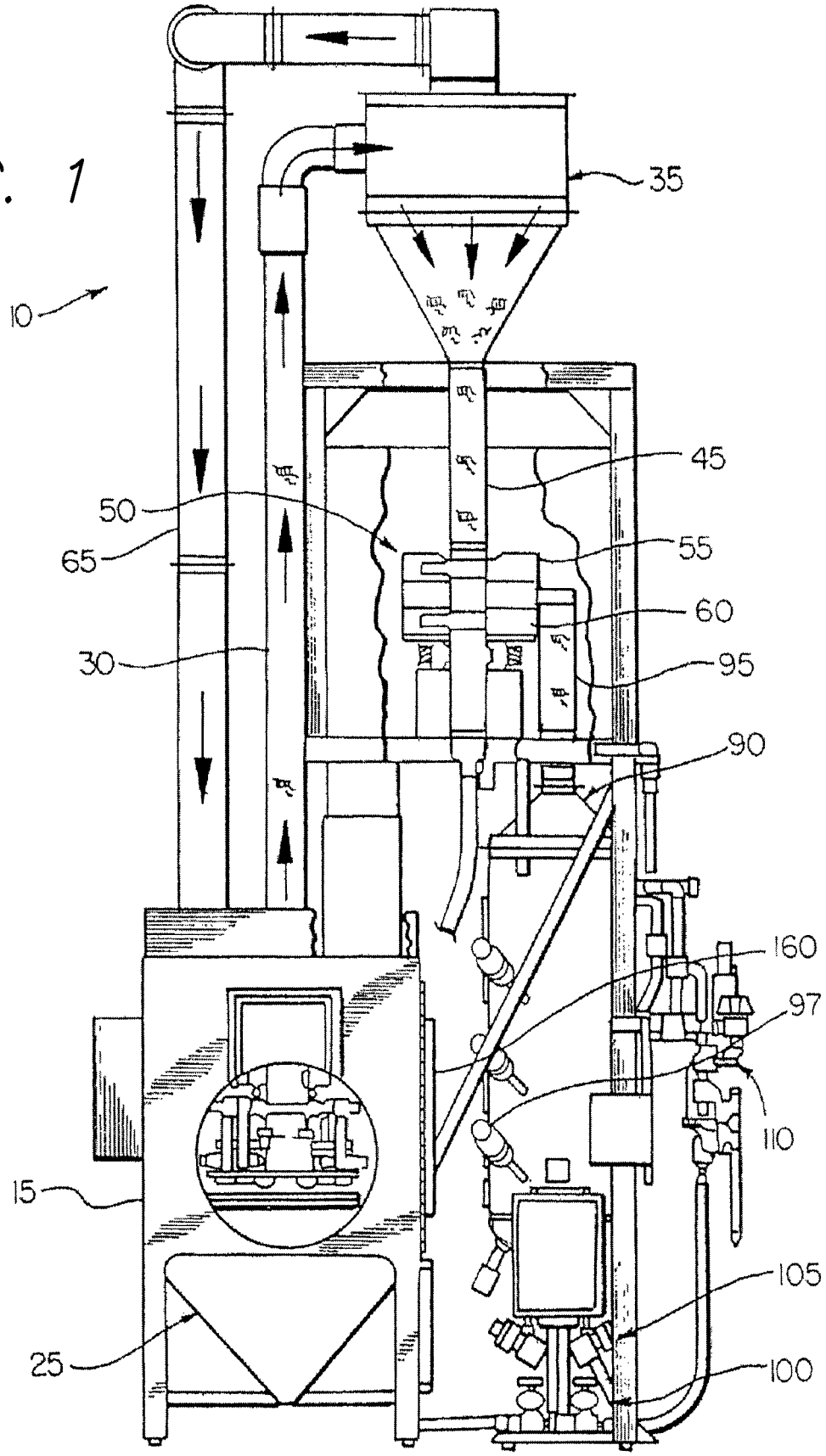
FIG. 1 is a front elevational view of a media blasting apparatus for treating a workpiece according to the invention.
Figure 2:
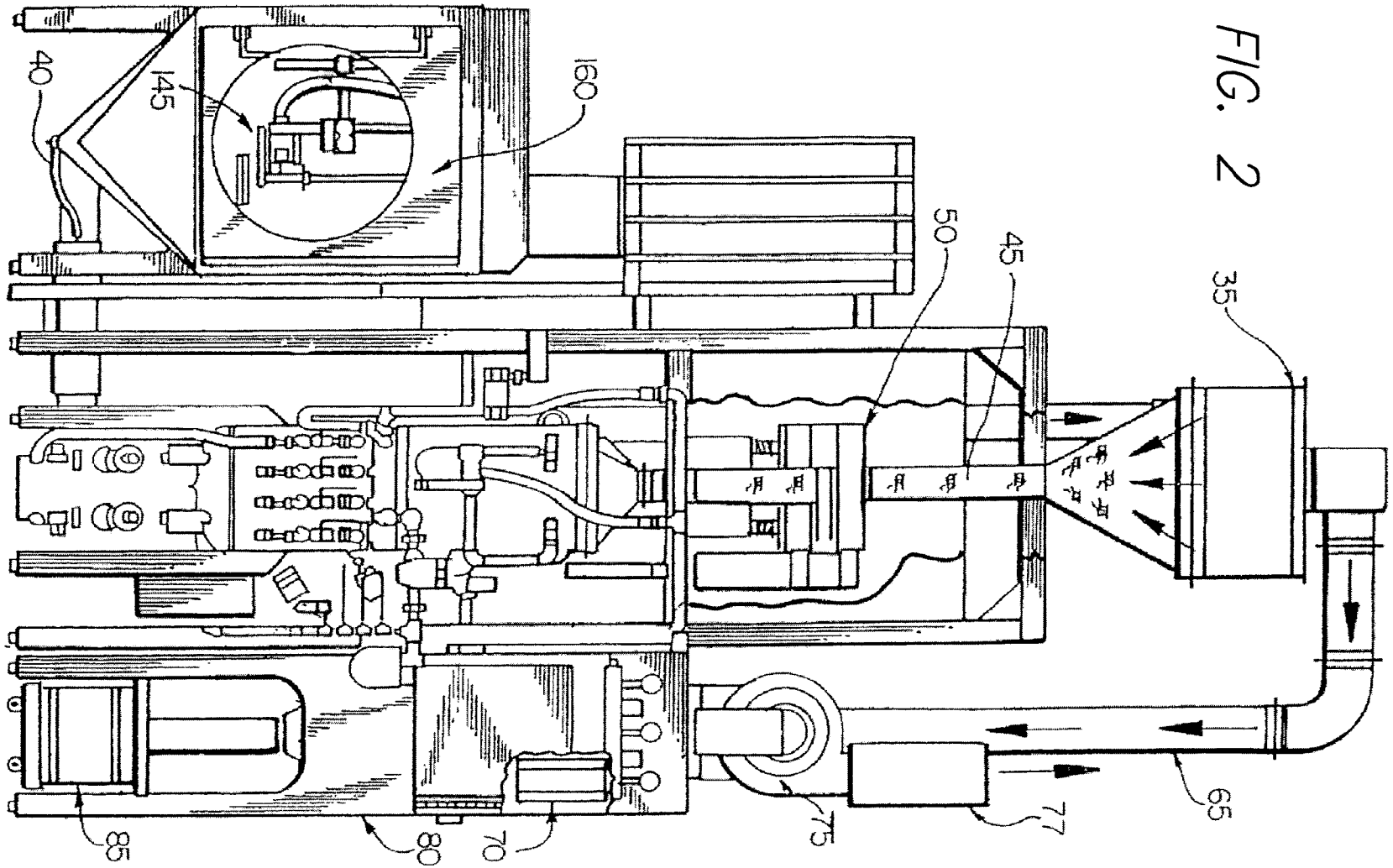
FIG. 2 is a right-side elevational view of the media blasting apparatus for treating a workpiece according to the invention.

Referring now to the drawings, FIG. 1 shows a front view of a media blasting apparatus according to the invention, generally indicated by the number 10. As illustrated, the media blasting apparatus 10 includes a blasting cabinet or chamber 15, in which a stream of media is directed against a workpiece 20. Such media may comprise, for example, cut wire, glass beads, ceramic beads or fine steel beads. The cabinet 15 is connected to a cabinet media hopper 25 for collecting the media that fall after collision with the workpiece 20. The fallen media will include broken pieces of media which have been recycled, as well as virgin or unbroken pieces. A conduit 30 connects the cabinet media hopper 25 to a media reclaim system, generally indicated by the number 35. As best illustrated in FIG. 2, the cabinet media hopper 25 is also connected to air supply means 40. The air supply means 40 provides air flow to the cabinet media hopper 25, for forcing the collected fallen media up through the conduit 30 to the media reclaim system 35.

As illustrated in FIGS. 1 and 2, the media reclaim system 35 includes a conduit 45 for conveying collected media to separation means 50. The separation means 50 is a two-deck system comprising a top screen 55 and a bottom screen 60. In a preferred embodiment of the present invention, the top screen is between 20 and 40 mesh gauge and the bottom screen is between 170-200 mesh gauge. The separation means 50 generally separates the fallen media into unbroken media and broken media of sufficiently large size to be recycled for use in the blasting operation and fines or dust which cannot be reused. The separator screens 55 and 60 are constantly vibrated to increase the efficiency of separation.

The media reclaim system 35 also includes a conduit 65. Conduit 65 is connected to a filter system 70 and to a blower-motor system 75. In a preferred embodiment, the blower-motor system 75 includes a blower muffler 77 for noise reduction. The blower-motor system 75 draws air from conduit 65, creating an upward draft in conduit 45 which carries the fines/non-reusable media from the separation means 50 up through conduit 45 into conduit 65 and into the filter system 70. The filter system 70 is connected to a dust collector 80 for collecting the fines and broken media. These are collected into a drum 85, which is periodically removed and emptied. In a preferred embodiment, the drum 85 is adapted to be rolled away and emptied. For example, the drum 85 may be coupled to a dolly.

As illustrated in FIG. 1, the separation means 50 is connected to a double pressure chamber 90 via a conduit 95. A media path is defined between the cabinet media hopper 25 and the pressure chamber 90. In a preferred embodiment, the double pressure chamber is held between 70 and 80 psi. The conduit 95 delivers the reclaimed reusable media to the double pressure chamber 90 where the reclaimed and reusable media are mixed with virgin media. In a preferred embodiment, the reclaimed media are of a mesh size greater than 100 mesh and the virgin media are of a mesh size between 60-100 mesh and preferably between 60-80 mesh. As stated previously, in the present invention, the media may comprise glass, ceramic, or fine steel beads. The virgin media are supplied to the double pressure chamber 90 through a plurality of media supply valves 97. The double pressure chamber 90 is also coupled to a media sensor monitor 100 for automatically controlling the supply of the virgin media. The supply of the virgin media is controlled to ensure adequate peening of the workpiece. Specifically, the supply of the virgin media is controlled to ensure that adequate compression stress is provided to the workpiece 20 so that a sufficiently high fatigue strength is obtained.

Advantageously, the double pressure chamber 90 also includes an automatic media metering on/off valve 105. The automatic media metering on/off valve 105 regulates the supply of the virgin/recycled media mixture to an air/media mix point, where the media are suspended in air. An automatic air valve 110 is coupled to the double pressure chamber 90 for suspending the media in air at the air/media mix point and then conveying the suspended media to the blasting cabinet 15 via blasting hoses 115.

The automatic metering on/off valve 105 in the present invention allows improved control of the media flow rate, as the media supply and air supply can be independently controlled. The presence of the automatic metering on/off valve 105 in the present invention is made possible by the use of a pressurized blasting system, rather than a suction type system, to deliver the media. In a suction type system, suction force is relied on to draw media from a media supply, through a media supply hose, to the suction gun. The presence of a metering valve 105 in a suction system, however, would reduce the pressure drop in the media supply hose causing a reduction in the suction force. The reduced suction force would, in turn, interfere with the delivery of media. The present system, on the other hand, is a pressure driven system so positive pressure can be relied on to force media through the media metering valve 105 to the media mix point.

A further advantage of the pressurized system is that it helps ensure an adequate media velocity is obtained. As mentioned above, media velocity is an important control parameter in ensuring that sufficient compressive stress is provided to a workpiece 20. The pressurized system helps ensure an adequate media velocity through control of the media flowrate and through the positioning of the air/media mix point. The media flowrate is controlled through the media metering valve 105. The air/media mix point is located sufficiently far from the blast hose so that the media have time to develop a desired or adequate velocity.

Figure 4:
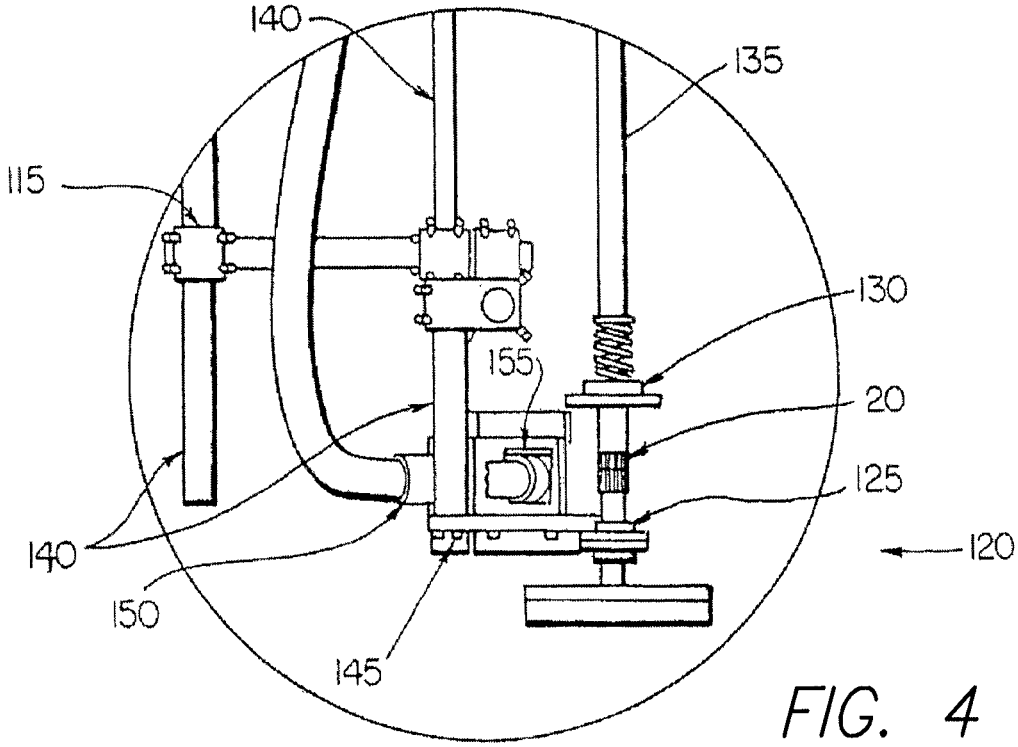
FIG. 4 is an enlarged, partial fragmentary, side elevational view of a blast station of the media blasting apparatus for treating a workpiece according to the invention.

A blasting station 120 inside the blasting cabinet 15 will now be described. As illustrated in FIG. 4, the workpiece 20 to be processed, i.e., blasted with media, is mounted on a part holder 125. Preferably, the part holder 125 has been hardened. The workpiece 20 is held in a predetermined position by a powered part hold-down apparatus 130. In the present invention, the powered part-hold-down apparatus 130 is preferably that described in U.S. Pat. No. 5,272,897, to which reference is again invited. The subject matter of U.S. Pat. No. 5,272,897 is incorporated herein by reference. The patented powered part-hold-down apparatus 130 provides variable, compensating, cushioned clamping for maintaining the workpiece 20 in the predetermined position during media blasting. The device as taught in U.S. Pat. No. 5,272,897 is very important to facilitate processing high volume quantities of parts. This is especially important for parts such as gears which tend to rotate when peened since the hold-down device prevents free spinning of the parts. The hold-down device also controllably rotates the parts at a desired rate of rotation. Rotation of the powered part-hold-down apparatus 130 is provided via a rotatable shaft 135.

Figure 3:
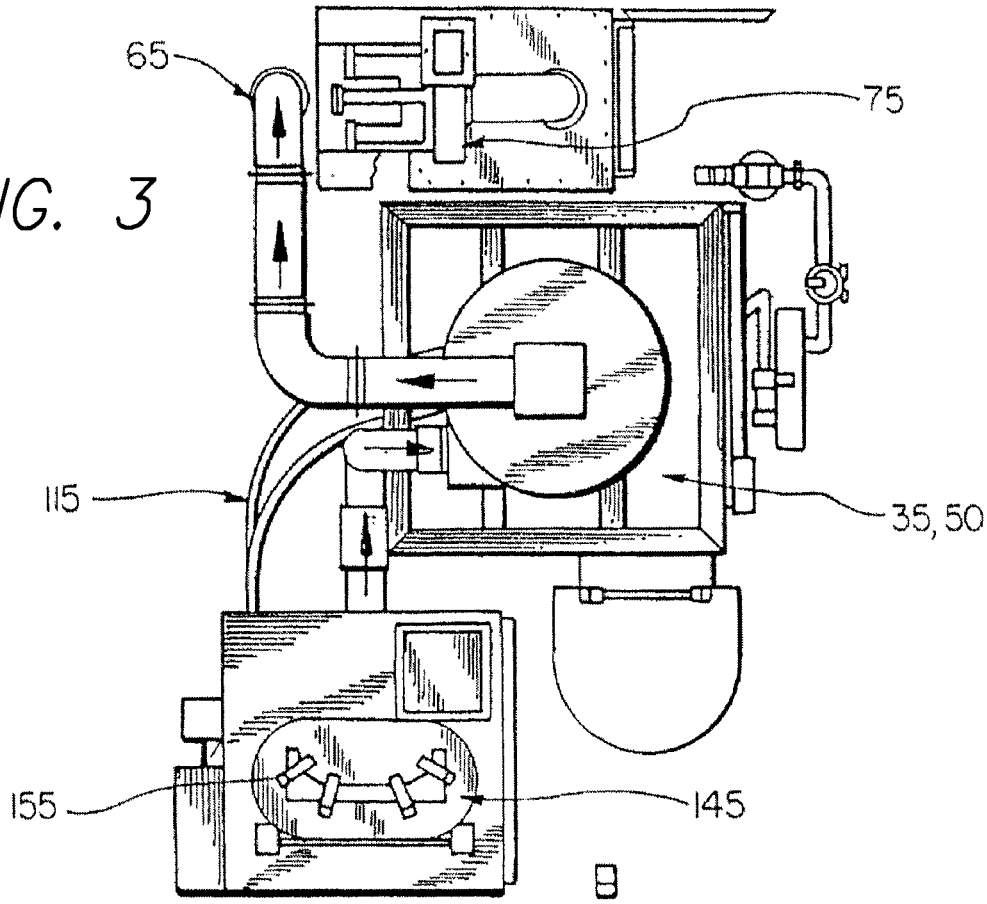
FIG. 3 is a top plan view of the media blasting apparatus for treating a workpiece according to the invention.

Hardened rods 140, preferably steel, provide a support system for a gun-rack assembly 145. The gun-rack assembly 145 holds a nozzle holder 150. A blast nozzle 155, to which the blasting hoses 115 are connected is attached to nozzle holder 150. The blast nozzle 155 directs a stream of media, suspended in air, against the surface of the workpiece 20. Preferably, the blast nozzle is positioned between approximately four to eight inches away from the workpiece 20. Although, only one blast nozzle 155 is illustrated in FIG. 4, it will be understood to those skilled in the art that a plurality of blast nozzles 155 could be used. In a preferred embodiment of the present invention, four such blast nozzles 155 are located in the blasting cabinet 15, as shown in FIG. 3. The blasting cabinet 15, containing the part-hold-down apparatus 130 and blasting apparatus is also provided with a door 160 for installation of a new workpiece 20.

Operation of the present media blasting device will now be described. After a workpiece 20 is placed in the part-hold-down apparatus 130, door 160 is closed. A stream of media suspended in air is then directed against the workpiece 20 by the blast nozzle 155. As the media are blasted, the workpiece is controllably rotated by the powered patented part-hold-down apparatus 130. This controlled rotation ensures even peening of the surface of the workpiece 20 and obviates use of a high directivity stream of media, hence making the use of water-supported media unnecessary.

The powered part-hold-down apparatus is preferably rotated at between 8-12 rpm. A rate of rotation of 10-12 rpm, however, has been found to be particularly effective for treatment of gears. The rate of rotation can be related to the degree of peening required and to the evenness of dimpling on the resulting surface. A slow controlled rotation permits even peening with uniform small dimpling and prevents the media stream from striking the surface unevenly, resulting in indentations that could act as crack precursors. Thus, for example, if the workpiece 20 is a gear, the controlled rotation ensures that media, e.g. cut wire, ceramic beads, fine steel beads, or glass beads, are directed towards the root and tooth face of the gear during the course of the rotation. By ensuring even peening, the operational characteristics of the workpiece 20 are improved.

In a one embodiment a smaller mass flowrate of media is blasted at higher velocity and for a longer time than in the prior art methods. The preferred flowrate depends on the type and size of media used, as well as the particular application involved. For treatment of gears, we have found a media flowrate of approximately 1.5-3 lb/minute to be effective. Of course, other flowrates could be used, depending on the results desired. This flowrate was found to be effective with glass media, ceramic media, and fine steel media of mesh size falling in the range of 50-100 mesh. In a preferred embodiment of the present invention, however, 60-100 mesh glass media are used. When 60-100 mesh glass media were used to treat certain gears, including those made using 8620 steel, a marked improvement in the operational characteristics of such gears was observed. The choice of media to be used depends upon the application and the relative economics. Ceramic and steel media last longer than glass; however, these media are more expensive.

After the media collide with the workpiece 20 they fall into the cabinet media hopper 25 and are then conveyed to the reclaim system 35. The reusable media are separated from the fines and dust and are returned to the blasting station 120 after mixing with virgin media. Such mixing reduces media wastage. The reuse of partially broken media also improves the polishing effect of the media upon the workpiece 20.

It has been found that satisfactory results may be achieved using glass media for blast treatment of certain gears, including those made of certain metals such as 8620 steel, gears made with other materials such as 5130 m steel have proved to be less than desirable using glass media. In general, the blast treatment with ceramic media of the invention has been found to be effective with a broad assortment of gear types made from a variety of metals. A number of oxide ceramics may be used in the process, such as for example, ZrO.sub.2, AL.sub.2 O.sub.3, SiO.sub.2, MgO, etc. Preferred media includes a crystalline zirconia uniformly enclosed in a silica glassy phase. Such media are sold under the tradename ZIRBLAST™ and ZIRSHOT™ by SEPR Co. of Paris le Defense, France.

Surprisingly, the blast treatment using ceramic media has been found to produce significantly better results then for blast treatment using glass treatment for certain metallic gears, e.g., in providing improved resistance to pitting of gear teeth surfaces as well as improved strength in the gear tooth root radius relative to prior methods. For such gear applications, it has been found that the ceramic media from between 40 to 100 virgin mesh, a flow rate of between 1 to 25 pounds per minute, cycle time between 15 seconds and 180 seconds, pressure of between about 25 and about 90 pounds per square inch (psi), a rotation rate of the gear of between about 5-25 rpm, and an Almen intensity of between 15 n and 28 n are effective in treating gears. Superior results have been observed in such gears under preferred processing conditions which included a small mass flow rate of between 1 and 3 pounds per minute, a pressures of between 70 and 80 psi, cycle time of between 15 seconds and 120 seconds, a rotation rate of the gear of about 8-12 rpm, media diameter of between about 0.210 mm and 0.150 mm mesh. Preferably, since ceramic media is relatively expensive, it is collected after blasting the gear and recycled by adding it to virgin media such that, after initial start up of the system, a recycled media mixture including virgin media and recycled media is used. In this preferred process, a 170-200 mesh screen is used as a bottom screen in the separation means of the media reclaim system to exclude small media fragments from the recycled media mixture.

In a still further embodiment of the invention, a method of treating a metallic gear with a fine metallic media blast stream is illustrated utilizing the apparatus described above. The preferred method includes a media flow rate between about 1 and 4, a diameter of the media between about 150 micron and 200 micron, a pressure between about 70 and 80 psi, an Almen range between about 18N and 26N. Preferably, the fine steel media is collected after blasting the gear and is recycled.

As steel shot media lasts significantly longer than ceramic or glass media, very little virgin media is required to be added to the apparatus. This results in significant reduction in the monitoring, and maintenance requirements as well as in the amount of media used for successful mass processing of gears. Metallic gears treated in this manner typically have fewer and less well defined dimples on their surface structure then for the media blasting processes disclosed herein using glass or ceramic media. Moreover, the gears so treated exhibit lesser fatigue strength then glass media and ceramic media treatments disclosed herein. However, in dynamometer testing, the fine steel media exceeded 70 hours of continuous use prior to failure which significantly exceeds the 40 hour to failure result expected on coated gears. Due to the reduced maintenance, monitoring, and media costs, the fine steel media process disclosed herein is a lower cost method which provides superior results to conventional shot peening of gears. Fine steel media peening is sufficient for many gears which exhibit good surface pitting resistance. When much higher degree of pitting is exhibited during dynamometer testing of gears, media blast treatment with ceramic media is preferred.

Using the ceramic blast treatment apparatus described herein, gears have been produced in a double peening step process as follows. A gear is media blasted by directing a first media (e.g., cut wire) against exposed surfaces on the gear. The step of media blasting (peening) with the first media makes the gear teeth root stronger. After media blasting with the first media, the gear is blasted by directing a second media (glass, ceramic or fine steel beads) against exposed surfaces on the gear. The step of media blasting (peening) with the second media makes the gear surface stronger and leaves the surface somewhat roughened. The roughened surface has dimples or indentations resulting from blasting with, for example, media between about 150 micron and 200 micron. Such blasting results in a dimple or indentation smaller than 150 micron and typically less than 75 micron. These small indentations provide high compressive stress and facilitate oil retention on the gear surface during use of the gear. Subsequent finishing reduces the size of the dimples or indentations but the high compressive stress and oil retention advantages remain on the gear surface.

Figure 5:
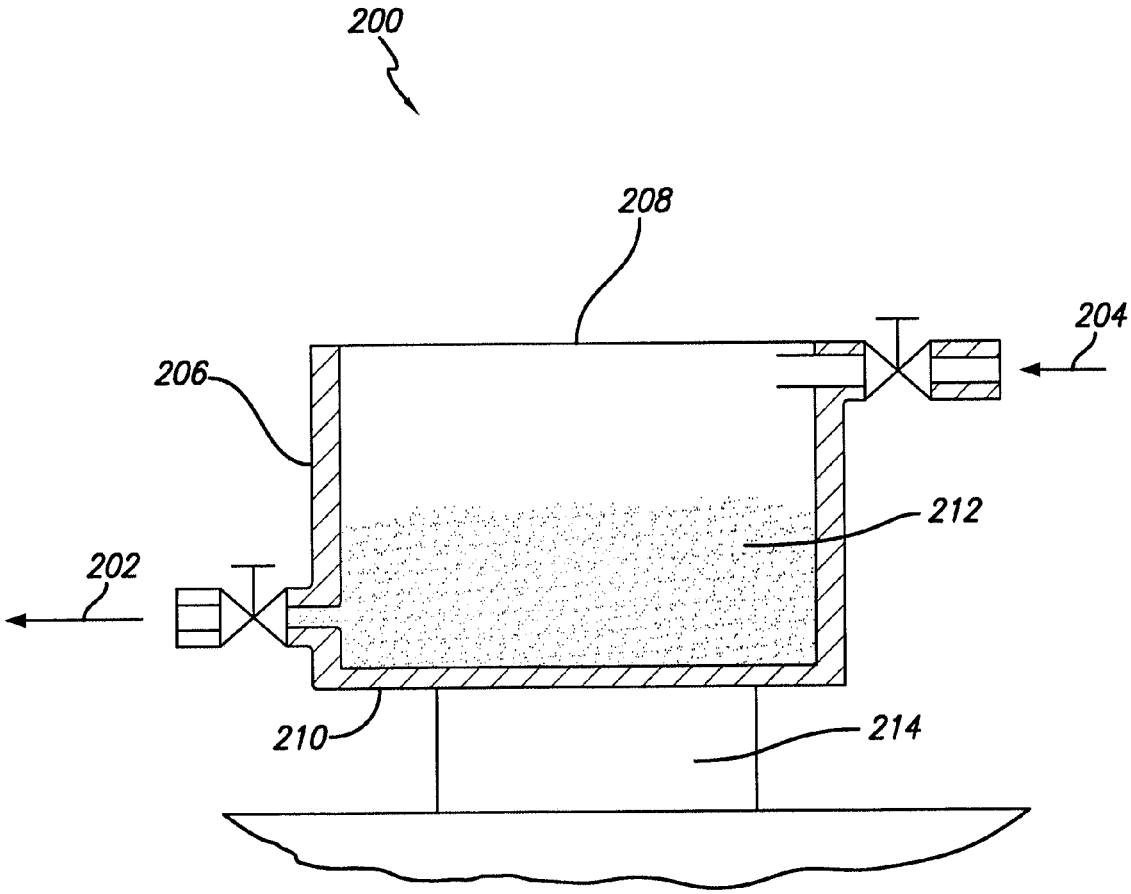
FIG. 5 is a cross sectional view of a container or bowl for immersing the workpiece (e.g., gear) in the superfinishing medium for treating the workpiece according to the invention.

After double peening the gear 201 is transferred to a bowl 200 containing a fine finishing medium 212 which may be a wet or dry medium. The fine finishing medium 212 is preferably a wet acidic medium. Bowl 200 is depicted in FIG. 5 (gears 201 are present in the fine finishing medium 212 but gears 201 are not shown in FIG. 5). Bowl 200 has an outlet 202, an inlet 204, sides 206, top 208 and a bottom 210. A wet acidic fine finishing medium 212 may be provided in sufficient amount to wet the gears 201 and ceramic media 212.

Figure 6:
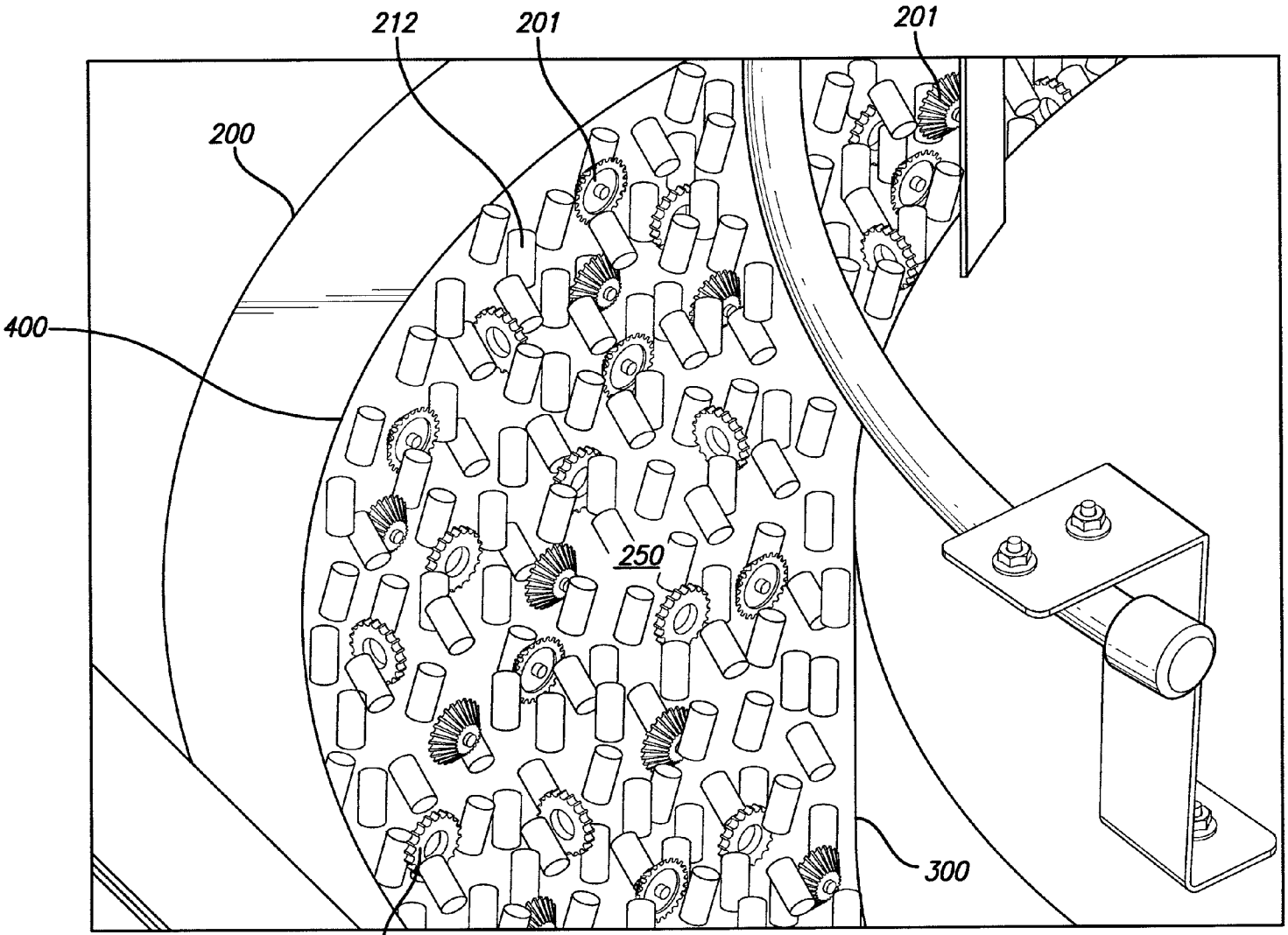
FIG. 6 is a top plan view of a portion of a bowl 200 with ceramic media and gears prior to closing the bowl for the vibration step.
Figure 7:
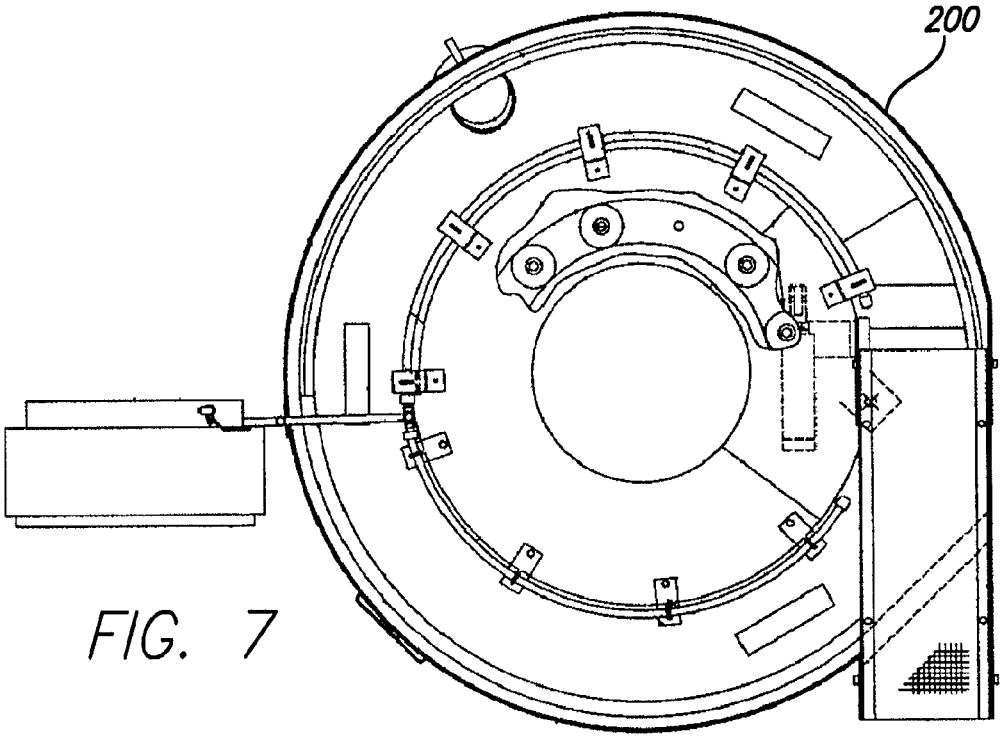
FIG. 7 is a top view of a container or bowl for coupling vibration to a workpiece (e.g., gear) while the workpiece is wetted with superfinishing medium for treatment of the workpiece according to the invention.
Figure 8:
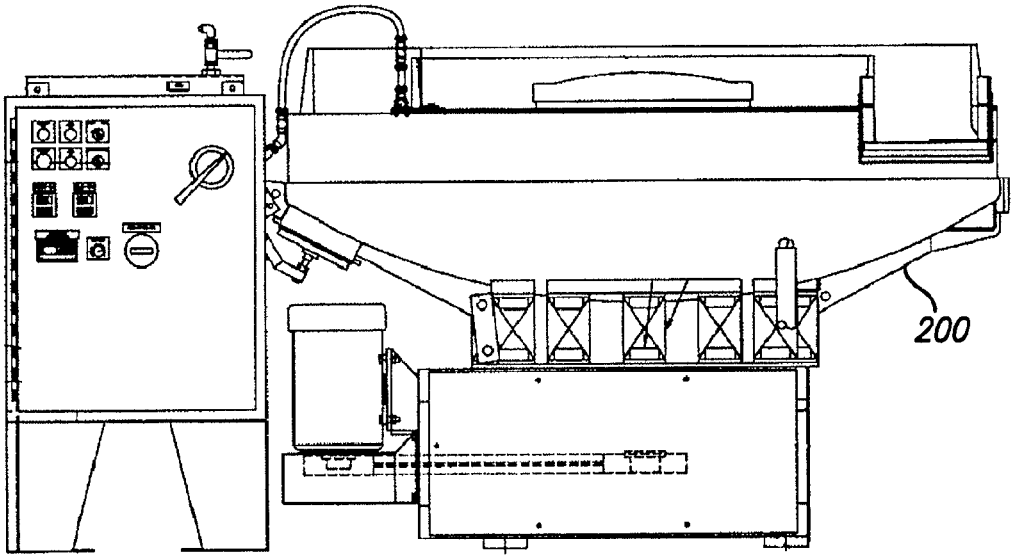
FIG. 8 is a side view of a bowl or container according to the invention.
Figure 9:
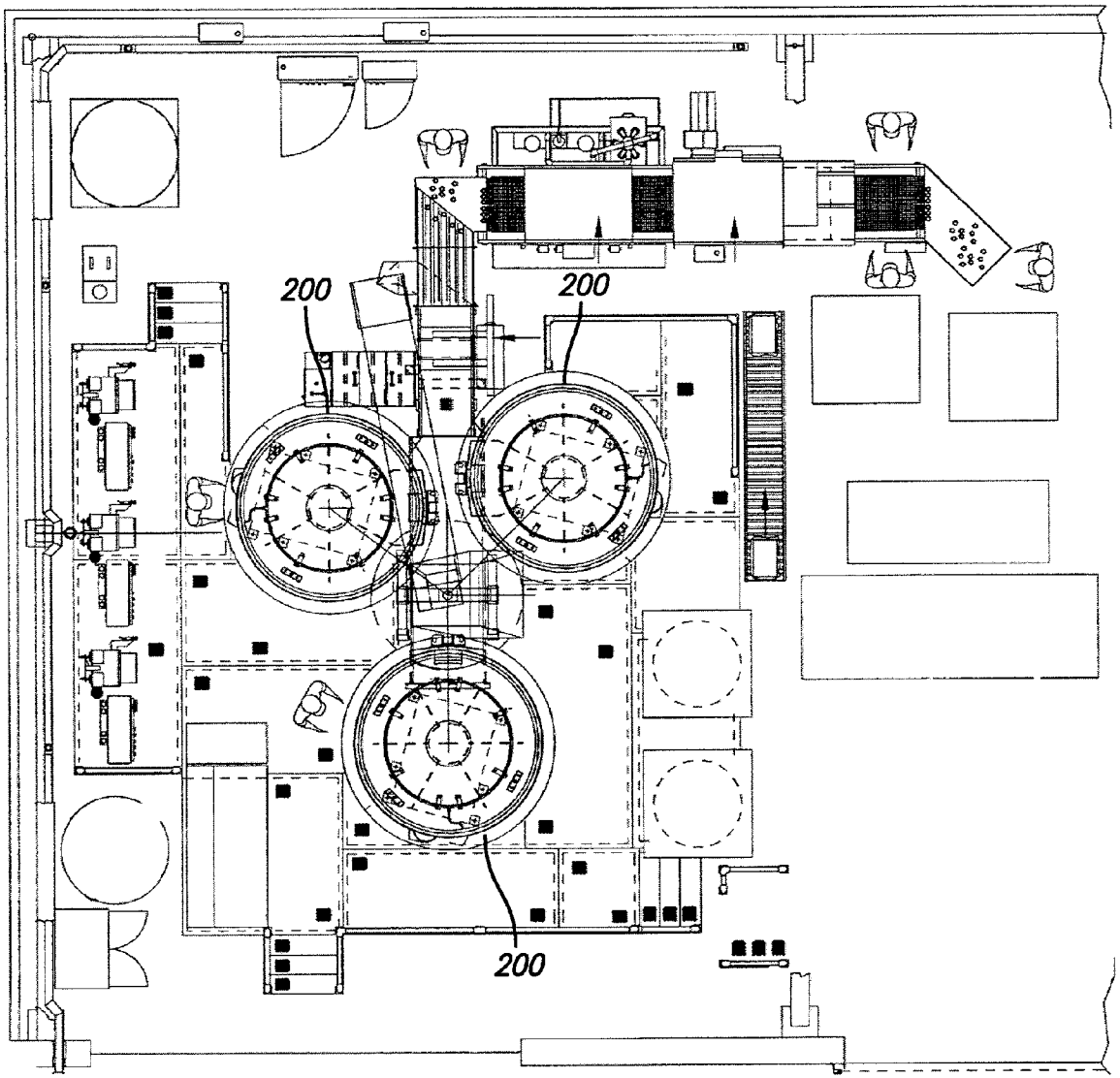
FIG. 9 is a top view of three bowls in a production facility according to the invention.
Figure 10:
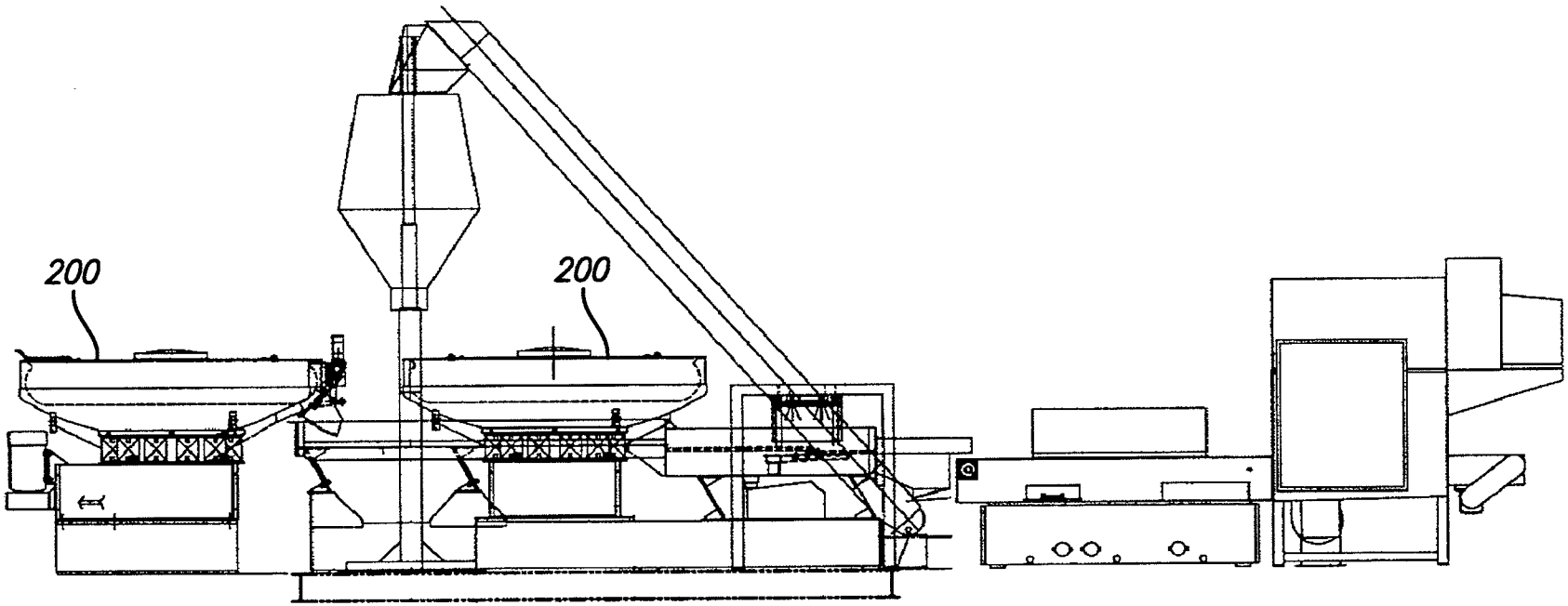
FIG. 10 is a side view of three bowls in a production facility according to the invention.

FIG. 6 is a photo of a portion of a bowl 200 with ceramic media 212 and gears 201 prior to closing the bowl 200 for the vibration step. The relative size of the gear 201 and ceramic media 212 shown are but one example of a gear 201 and ceramic media 212. Typically the ceramic media is smaller than that shown in FIG. 6. That is, the relative size of the ceramic media 212 and gears 201 is such that the media 212 is small enough to fit into the space between the gear teeth so that during fine finishing (vibration) the gear surfaces between the teeth are fine finished. Vibration of the bowl 200 is coupled to the bowl 200 via vibration coupler 214. One example of a fine finishing medium 212 comprises a mixture of ceramic media with a slightly acidic solution. Another example of fine finishing media comprises zinc chips, water and aluminum oxide powder. FIG. 7 shows a portion of the production facility with three covered bowls 200. FIGS. 8-10 are drawings of the bowls in a production facility. Each bowl is supported on the floor by three springs (more or fewer springs may be used). As seen in FIG. 7 the three bowls 200 are covered for sound reduction, etc. The bowl 200 is typically made of steel and has a polyurethane liner which couples the vibrations to the medium. As seen in, for example, FIG. 6, the inside of the bowl 200 has a channel 250 extending around the entire inner periphery of the bowl 200. The center portion of the bowl is in the form of a cylinder (see outside wall of the cylinder at 300 in FIG. 6) with the outside peripheral wall 400 being spaced from the cylinder wall 300 by a channel 250. An opening with a removable cover is provided in the side of the bowl 200 to allow the contents to be removed. The inside of the channel 250 has a banked shape so that when vibrations are coupled to the bowl the contents move along the channel in a circular flow. Other channel shapes may be imparted to the channel wall or floor to move the contents in a circular fashion. This movement enhances mixing of the contents whereby all surfaces of the gears 201 are exposed and subject to the smoothing action of the media 212 in the channel 250 with the gears 201.

In a preferred embodiment a gear is wetted with the fine finishing medium in the bowl and vibrations are coupled to the bowl to vibrate the superfinishing medium with the wetted gear therein. The vibration is continued for a time sufficient to achieve a gear which has a finish Ra of about 5-25 microns. During vibration (fine finishing) additional water and/or fine finishing medium may be added via one or more inlets 204. Excess fine finishing medium, water etc, may be removed via outlet 202. Fine finishing is continued to smooth the gear (workpiece) surfaces but to leave sufficient dimples, indentations, etc. to enhance oil retention at the surface of the gear. A finish of zero Ra is not desired as this leaves a completely smooth finish with no surface dimples, indentations, etc. for enhancing oil retention. It is thought that the dimples provide locations for the oil to collect and be retained during gear operation whereby an amount of lubrication combines with gear smoothness to add to the working life of the gear. It has been found that fine finishing to a desired range of about 5-25 microns after the double peening discussed above adds significantly longer life to gears. After fine finishing the gear is removed from the bowl, washed and rinsed. The gear is treated with rust inhibitor in a final step whereby a gear with enhanced wear properties is provided.

In another embodiment the gears are fine finished in a bowl without the addition of liquid medium (i.e., with dry fine finishing medium). In this embodiment the gears are in effect fine finished while dry and in the presence of wear material that smoothes the gear surface, but wherein the wear material is not in liquid form. Coupling vibrations to the container to vibrate the fine finishing medium with the gear reduces the size of the indentations on the surfaces of the gear leaving compressive stress and oil retention advantages remaining on the gear surface. The surface resulting after finishing has smoothness as discussed above with indentations resulting from peening and reduced by but remaining after finishing.

The media peening steps result in a gear with a residual compressive stress in the gear root radius of between at least 80 KSI and in the gear surface of at least 80 KSI. At depths (in inches) of 0.0005, 0.001 and 0.002 the residual compressive stresses typically will be at least 100 KSI. Using the above discussed process parameters, gears have been produced with a residual compressive stress in the gear root radius of at least 100 KSI with typical values of at least 130 KSI at a depth of 0.000 inch (surface), 175 KSI at 0.0005 inch, 200 KSI at 0.001 inch and 225 KSI at 0.020 inch.

For gears treated by the above-discussed preferred two step media blasting method followed by fine finishing tests confirm that gears so treated exhibit superior performance relative to gears not treated with this three step process. It has been found that gears treated with this preferred process exhibit superior fatigue strength having performed adequately with little evidence of wear for hundreds of hours in tests. In contrast, gears treated by conventional methods can be expected to fail in as little as 20 hours in dynamometer testing.

While the method of media blast treatment for gears is disclosed herein with respect to a hold down apparatus, it is contemplated that other conventional part holders and blasting apparatus may also be used with the steps described herein. The above discussed process recognizes that most often gears need steel peening at the gear root to prevent fatigue bending in the root radius. This disclosure recognizes that sometimes the first peening step is not required and the only peening needed is with the ceramic or glass beads. This latter instance is for gears that are subjected to less stress and perhaps lower expected longevity.

The applicant has provided description and figures which are intended as an illustration of certain embodiments of the invention, and are not intended to be construed as containing or implying limitation of the invention to those embodiments. It will be appreciated that, although applicant has described various aspects of the invention with respect to specific embodiments, various alternatives and modifications will be apparent from the present disclosure which are within the spirit and scope of the present invention as set forth in the following claims.

What is claimed:

1. A method of processing a metallic gear comprising providing a metallic gear, directing a first peening media at the metallic gear to expose a plurality of surfaces on the metallic gear to the first peening media to enhance the strength and wear properties of the of the teeth roots of the gear, directing a second peening media at the metallic gear to expose a plurality of surfaces on the metallic gear to the second peening media to enhance the toughness of the surface of the gear, providing a container, placing a fine finishing medium in the container, after directing the first peening media at the metallic gear and after directing the second peening media at the metallic gear, placing the gear with the fine finishing medium in the container, coupling vibrations to the container to vibrate the fine finishing medium with the gear to smooth the exposed gear surfaces, removing the gear from the container, washing the gear, and rinsing the gear with rust inhibitor.

2. A method according to claim 1 wherein the fine finishing medium comprises zinc chips, water and aluminum oxide powder.

3. A method according to claim 1 wherein the container is a polyurethane lined steel bowl.

4. A method according to claim 1 wherein the vibrations are continued for a time sufficient to achieve a gear finish Ra of about 5-25 microns.

5. A method of claim 1 wherein the first peening media comprise cut wire.

6. The method of claim 1 wherein the second peening media comprise one of glass beads, ceramic beads and fine steel beads.

7. The method of claim 6 wherein the second peening media have a diameter of less than about 250 microns.

8. A method according to claim 1 wherein the first peening media comprise ceramic media which is directed at the metallic gear at a pressure of between about 25 and about 90 pounds per square inch and wherein the ceramic media has a diameter of between about 0.210 mm and about 0.150 mm when added as virgin media.

9. A method of claim 1 wherein the fine finishing media comprise an acidic media.

10. A method of claim 1 wherein the fine finishing media comprise a dry media.

11. The method of claim 1 wherein directing a first peening media at the metallic gear provides indentations on the surfaces of the gear and increase the compressive stress on the gear surface with the indentations facilitating oil retention.

12. The method of claim 11 wherein coupling vibrations to the container to vibrate the fine finishing medium with the gear reduces the size of the indentations on the surfaces of the gear leaving compressive stress and oil retention advantages remaining on the gear surface.

13. The method of claim 1 wherein peening results in a gear with a residual compressive stress in the gear root radius of at least 80 KSI and in the gear surface of at least 80 KSI.

14. The method of claim 1 wherein peening results in residual compressive stress of 175 KSI at 0.0005 inch.

15. The method of claim 1 wherein peening results in residual compressive stress of 225 KSI at 0.020 inch.

* * * * *